US006357692B1

(12) United States Patent
Magnusson et al.

(10) Patent No.: US 6,357,692 B1
(45) Date of Patent: Mar. 19, 2002

(54) YARN FEELER

(75) Inventors: Patrik Jonas Magnusson, Boras; Staffan Hagstroem, Timmele, both of (SE)

(73) Assignee: IRO Patent AG, Baar (CH)

( * ) Notice: Subject to any disclaimer, the term of this patent is extended or adjusted under 35 U.S.C. 154(b) by 0 days.

(21) Appl. No.: 09/367,410

(22) PCT Filed: Dec. 17, 1998

(86) PCT No.: PCT/EP98/08300

§ 371 Date: Nov. 1, 1999

§ 102(e) Date: Nov. 1, 1999

(87) PCT Pub. No.: WO99/31001

PCT Pub. Date: Jun. 24, 1999

(30) Foreign Application Priority Data

Dec. 17, 1997 (DE) ..... 197 56 242

(51) Int. Cl.[7] ..... B65H 57/00; B65H 23/04

(52) U.S. Cl. ..... 242/615; 242/364.7; 242/615.4

(58) Field of Search ..... 242/364.7, 615, 242/615.4

(56) References Cited

U.S. PATENT DOCUMENTS

| | | | | | |
|---|---|---|---|---|---|
| 3,737,112 | A | * | 6/1973 | Tellerman et al. | 242/364.7 |
| 3,759,455 | A | * | 9/1973 | Clemens | 242/364.7 |
| 3,844,504 | A | * | 10/1974 | Lawson | 242/364.7 |
| 4,226,379 | A | * | 10/1980 | Brouwer et al. | 242/364.7 |
| 4,265,176 | A | * | 5/1981 | Sato | 242/615 X |
| 4,525,705 | A | | 6/1985 | Edmé et al. | |
| 4,662,575 | A | * | 5/1987 | Fecker | 242/365.7 |
| 4,710,646 | A | | 12/1987 | Curda et al. | |
| 5,424,723 | A | | 6/1995 | Krebs | |

* cited by examiner

*Primary Examiner*—Donald P. Walsh
*Assistant Examiner*—Minh-Chau Pham
(74) *Attorney, Agent, or Firm*—Flynn, Thiel, Boutell & Tanis, P.C.

(57) ABSTRACT

A yarn feeler, such as for a yarn sensor in a yarn feeding device, has a feeler with an essentially even resting surface which is to be brought into contact with a yarn. The feeler foot includes, at least in the region of it resting surface an uninterrupted surface in order to gently treat the yarn during detection and to avoid the deposition of contaminants in the feeler foot.

22 Claims, 3 Drawing Sheets

YARN FEELER

FIELD OF THE INVENTION

The invention relates to a yarn feeler, such as for a yarn sensor in a yarn feeding device, the yarn feeler having a feeler foot which forms a resting surface which contacts the yarn.

In yarn processing technologies yarn feelers are used which mechanically act on a yarn, e.g., in yarn feeding devices to detect yarn turns which mainly move transversely to their yarn axis. A design has become standard wherein the yarn feeler is bent from a wire section such that its feeler foot forms a substantially U-shaped tongue oriented with its longitudinal axis substantially laterally in relation to the yarn axis so that the yarn to be detected is sweeping along the lower surface of the feeler foot.

BACKGROUND OF THE INVENTION

From operation and maintenance Manual IWF 9007, 9107,9207 of IRO AB,SE, reference number 07 -0939-0812-01/9647, pages 10, 44, 50 and 51, a yarn feeler is known which is designed as a double leg wire bracket and is pivotably held by an axis supported in a housing of a yarn feeding device. The yarn feeler has a feeler foot which is bent downwardly and rests on the yarn turns of a yarn store which wanders forwardly on the storage drum of the yarn feeding device. The yarn feeler can be displaced by the yarn turns out of a home position in order to thereby generate signals for a control or monitoring means. The feeler foot, being U-shaped and having two legs, points in the moving direction of the yarn turns and is inclined obliquely downwardly. During operation of the yarn feeding device contamination and mainly lint is collected in the U-base of the feeler foot until a resulting lint tail is trails from the feeler foot. Said lint collection at the U-base and the lint tail may not only lead to functional disturbances during the yarn detection but also to disturbances downstream of the yarn feelers and to fabric faults if it is torn off and travels further with the yarn. The danger of a disturbance by such collections is particularly high for yarn feelers which permanently rest on yarn turns during normal operation, e.g. as a yarn breakage sensor monitoring presence of the first yarn turns in the yarn supply in a yarn feeding device.

It is a task of the invention to create a yarn feeler of the kind as mentioned above which is characterised by an enhanced operational reliability.

More specifically, the feeler foot of the yarn feeler is provided with an uninterrupted surface at least in the region of its yarn resting surface.

The uninterrupted surface at least in the region of the resting surface of the feeler foot prevents collection of contamination and lint in the feeler foot and suppresses the generation of an undesirable lint tail. In addition the yarnis loaded gently by the contact pressure of the yarn feeler due to the uninterrupted surface in the region of the resting surface, which is expedient in case of delicate yarn qualities and/or high yarn speeds. In this way the overall operational safety of the yarn feeler is enhanced, since disturbances by collections of contaminations in the feeler foot are avoided and since the mechanical load on the yarn being detected is reduced (reduced yarn breakage danger).

The feeler foot can include a shank which is bent upwardly from the main plane of the resting surface, and the uninterrupted surface extends at least into the root of the shank of the feeler foot in order not to offer any possibilities for lint, unavoidably occurring during the yarn processing, to get caught.

The uninterrupted surface has an essentially linear generatrix which is substantially parallel to the yarn axis. Thus, the contact pressure of the feeler foot on the yarn is distributed evenly. The essentially linear generatrice can be made concave, truly straight or convex, depending on the geometrical form of the yarn during detection.

The uninterrupted surface ought to be curved convexly or consist of several surface sections in order to generate a low and constant resistance to the passing yarn and to have the feeler foot properly displaced by the yarn.

The uninterrupted surface should have a part in the tip region of the feeler foot which is essentially parallel to the storage drum periphery. The size of said surface should suffice to cover two adjacent yarn turns simultaneously, particularly in case of yarn separation on the drum.

The uninterrupted surface should be rounded or chamfered in order to exclude edges or cutting regions dangerous for the yarn, particularly when said surface forms the resting surface of the feeler foot.

The feeler foot is a formed part, preferably of metal or plastic, with the uninterrupted surface integrated therewith in a unitary fashion. Said embodiment is advantageous from a manufacturing standpoint. Since the feeler foot should act with only its surface, it even can be made hollow in order to save weight.

The shank is formed by two spaced apart legs which extend to the feeler foot with their outer contours either parallel to each other or converging towards the resting surface. The latter design is particularly important when using the feeler foot in a yarn feeding device, since during threading-up or due to other influences the yarn may temporarily be lifted and hence contact the shank. The converging shank then guides the yarn due to the yarn tension below the resting surface automatically so that entangling of the yarn at the feeler foot or the shank, respectively, can be omitted.

Alternatively, the feeler foot is formed from a wire section, e.g. by bending, and the interspace between its legs is filled by an insert (hollow or solid). The insert so to speak occupies the interspace so that contaminants and lint cannot deposit there.

The feeler foot as bent from wire material is provided with a shoe-like cover which hinders the deposition of contaminants and lint in the interspace between the legs and which also forms the resting surface.

The interspace between the legs of the feeler foot as bent from wire material is covered by a membrane-like plane element which either is set back behind the resting surface or even forms the resting surface, respectively. Also in this case the uninterrupted surface between the legs counteracts to the deposition of contaminants and lint.

The feeler foot is a runner-like plane element defining the resting surface and the uninterrupted surface. It is mounted on the shank such that it is freely ending. This is a particularly lightweight and structurally simple embodiment whereby the deposition of contaminants and lint is avoided.

In the event that a cavity should remain when covering the interspace between the legs of the feeler foot as bent from wire material, said cavity can be occupied by a filling in order to hinder the entrance of contaminants or lint. Said filling could e.g. be foam material or another material (e.g. a potting material) having no other function than the occupation of the cavity.

BRIEF DESCRIPTION OF THE DRAWINGS

A yarn feeler of conventional design as well as embodiments of the invention will be described with the help of the drawings, in which.

DETAILED DESCRIPTION

Figure 1:
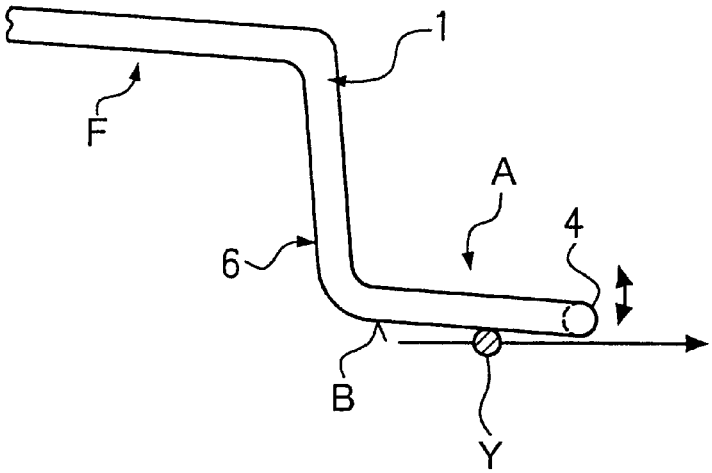
FIG. 1 (prior art)
FIGS. 1 and 1A illustrate side and plan views, respectively, of a conventional yarn feeler.
Figure 1A:
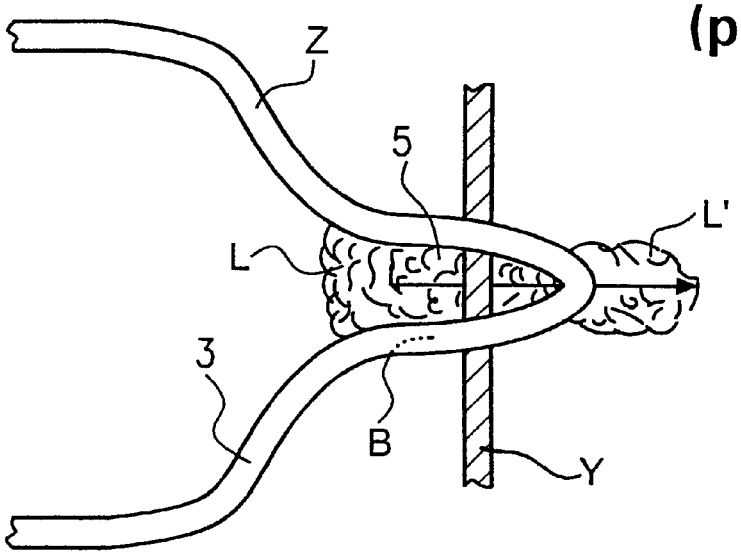
FIG. 1A (prior art)

FIGS. 1 and 1A illustrate a yarn feeler F of conventional design during the detection of yarn. The yarn feeler is bent from a wire material 1 with legs 2 and 3 as a double-leg bracket, said legs having a deflection point in a base 4 at a feeler foot A which is offset downwardly from the yarn feeler F via a shank 6. By the lower sides of said legs 2, 3 a resting surface or resting surfaces B are defined on feeler foot A along which the yarn Y slides during detection. Via said resting surface B the yarn feeler F is lifted in the direction of a double arrow in order to e.g. generate a signal representing the presence of the yarn Y (occasionally of several yarn turns) below feeler foot A. In the illustration of FIG. 1A it can be seen that an interspace 5 exists between the legs 2, 3 in the region of the feeler foot A which interspace tapers like a corner towards base 4. During yarn processing lint is unavoidably generated having the undesirable tendency to collect at each suitable location and to form lint bunches. As experienced, interspace 5 is relatively quickly filled with contaminants and lint commonly forming a lint bunch L. In the event that then further lint follows, a lint tail L' can be generated which is dragged in the moving direction of the yarn Y or of the yarns Y. The lint bunch L or the lint tail L' can lead to functional disturbances and can interfere with the proper operation of the yarn feeler. Moreover, the feeler foot A by its resting region B essentially is contacting the yarn Y at two lines so that occasionally high local loads might result for the yarn.

Figure 2:
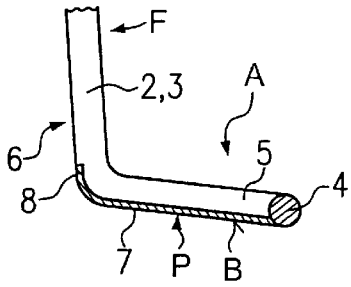
FIGS. 2 to 6 illustrate different embodiments of yarn feelers according to the invention.

In FIG. 2 in a yarn feeler F made from wire material with legs 2, 3 in feeler foot A, a plane element 7 having an uninterrupted surface P is inserted at the region of resting surface B. Said element 7 even can, as shown at 8, extend from feeler foot A into the shank 6. The feeler foot A is resting on the yarn with said surface P and both legs 2, 3 forming said resting surface B. No lint can be caught in interspace 5, or lint can be deposited here only to an extent which is not dangerous for the detection operation.

Figure 3:
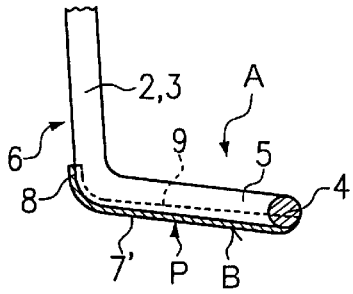

In FIG. 3 at the lower side of feeler foot A, a plane element 7' is mounted which occasionally even is extended (at 8) into shank 6. Element 7' commonly forms the resting surface B as well as the interrupted surface P with which the feeler foot A is acting on the yarn. Expediently, the edges of element 7' are rounded upwardly (indicated at 9). Lint cannot be collected in interspace 5 or only to an extent that does not create a dangerous situation.

Figure 4:
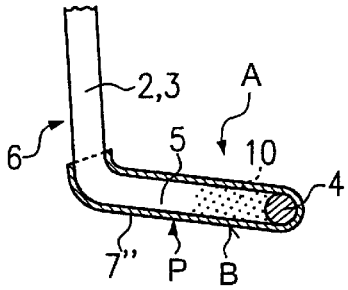

In FIG. 4 a shoe-like cover 7" is pulled over the feeler foot A which cover occasionally extends into shank 6 and covers the interspace 5 from below as well as from above. The resting surface B and the surface P, both contacting the yarn, are formed by cover 7". The cavity provided in the interior of cover 7" in the region of the interspace 5 may contain a filling 10, e.g. foam material or another material. It would also be possible to close the lining 7" from the shank side only.

Figure 5:
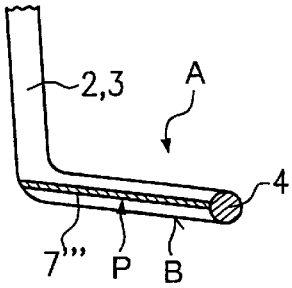

In FIG. 5 a membrane-like, plane element 7'" is inserted in feeler foot A between the legs 2, 3 which element forms the surface P and covers the interspace 5 but is situated higher than the resting surfaces B. By this design it is impossible for contaminants and lint to collect there and to cause disturbances.

Figure 6:
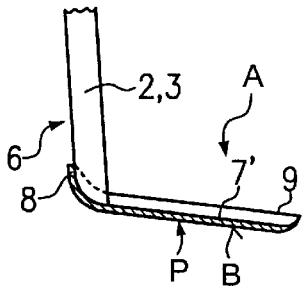

In FIG. 6 a plane element 7' is provided which is similar to that used in FIG. 3 to cover the interspace 5. In FIG. 6 the plane element 7', which may have the shape of a runner, may directly form the feeler foot A. For this purpose the element 7' is secured to the legs 2, 3 forming the shank 6. The element 7' carries the surface P and forms the resting surfaces B, by which the feeler foot A acts on the yarn. Said element 7' may have an edge 9 rounded upwardly and may be extended at 8 into shank 6.

Figure 7:
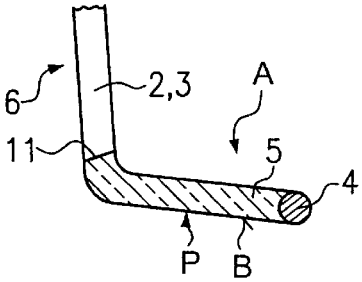
FIGS. 7 and 8 respectively illustrate a crosssection and a plan view of a further embodiment of a feeler foot of a yarn feeder.
Figure 8:
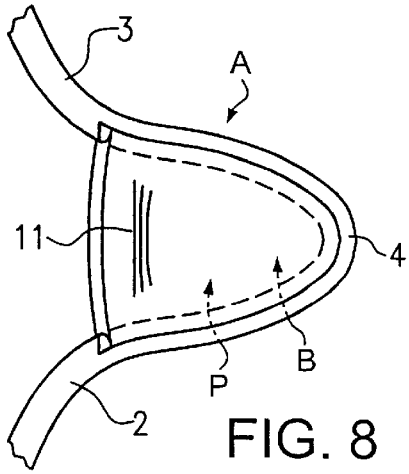

In FIG. 7 an insert 11 is inserted into the feeler foot A between legs 2, 3, which insert fills the interspace 5 and may extend occasionally into resting surface B or even may form same. The insert 11 defines an uninterrupted surface P hindering the deposition of lint and contaminations within interspace 5. Occasionally the insert extends into shank 6 (as shown) and smoothly follows, e.g. with a concave neck the curvature of the legs 2, 3 in case of round wire material. The insert which, e.g. consists of plastic material, also could be glued or otherwise secured in a suitable fashion.

In FIGS. 2 to 8 the surface P may be even and substantially parallel to the main plane of the feeler foot A. Alternatively it is possible to provide a downwardly convex curvature, particularly when seen in a longitudinal section and/or in a cross-section. Said elements 7, 7', 7", 7'" can be formed from plastic material or sheet metal.

Figure 9:
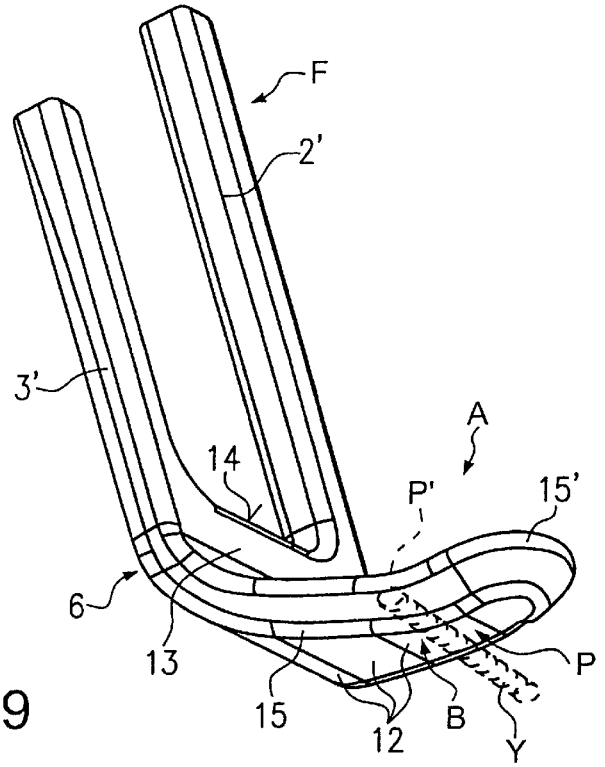
FIG. 9 illustrates a bottom perspective view of a further embodiment of a feeler foot.

In FIG. 9 the feeler foot A with its legs 2', 3' is a solid or hollow formed part of plastic material or metal which is made either unitary with the not shown feeler arm F or is mounted to the latter. The uninterrupted surface P at the lower side of feeler foot A is—in moving direction of the yarn Y—formed with a concave curvature or is formed by discrete surface sections 12 bluntly joined with one another. At the tip of the feeler foot A a substantially even surface section ought to exist which should be essentially parallel to the periphery of the storage drum and should have a size ensuring that even in case of yarn separation two adjacent yarn turns can be covered simultaneously. Moreover, the surface P may be essentially even or concavely or convexly curved in the direction of the yarn longitudinal axis. The outer edge region of surface P expediently is rounded or chamfered (at 15 or 15'). The surface P is extended to the root of the shank 6 and terminates in a lateral edge 14 and a lateral wall 13. Also, the upper side of the feeler foot A is provided with an uninterrupted surface P'. The spaced apart legs 2', 3' either are parallel or converge towards the feeler foot A. Said design also is used in the embodiments of FIGS. 2 to 8, particularly in view of the use of the yarn feeler in a yarn feeding device wherein (e.g. during threading-up) the yarn may sidewardly contact one of the legs and then is automatically pulled down by its yarn tension below resting surface B in order not to remain caught at the yarn feeler or feeler foot. Light metal, for example, is used for making the feeler foot.

Figure 10:
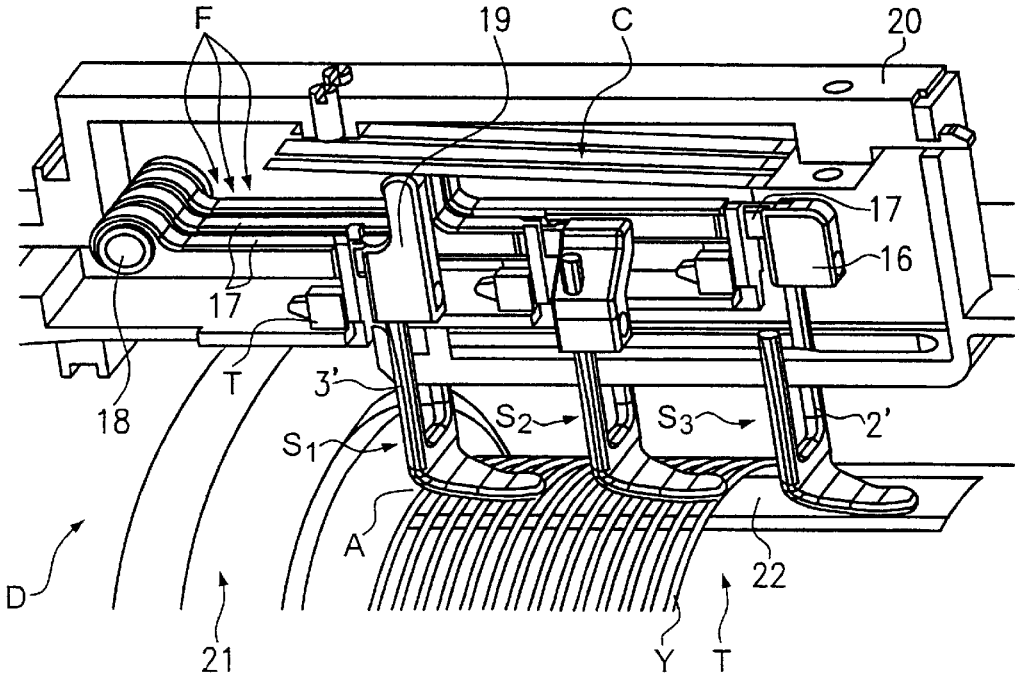
FIG. 10 illustrates a perspective side view, in partial cross-section, of a sensor device having several yarn feelers in a yarn feeding device.

In FIG. 10 a winding element 21 of a yarn feeding device D is shown adjacent to a stationary storage drum T on which the yarn Y is wound in subsequent adjacent turns into a yarn supply from which the yarn during consumption is withdrawn overhead of the storage drum T to the right side in FIG. 10. In said region the yarn feeding device has three yarn sensors S1, S2, S3, each with a feeler arm F and feeler foot A, e.g. according to FIG. 9. The feeler feet A extend from a sensor housing 20 towards storage drum T which is formed in this area with a longitudinally extending depression 22 bridged over by yarn Y. The first sensor S1, e.g. is a yarn breakage sensor monitoring if the first turns of the yarn supply are properly present, or not. As long as yarn turns are present the feeler arm F remains in a lifted position. If said first windings are missing the feeler arm F sinks downwardly and generates a signal indicating a fault (yarn breakage). The second sensor S2 is a minimum sensor monitoring the minimal allowable size of the yarn supply on the storage drum T and generating a signal in case of absence of the yarn in this region by which signal the drive of the winding element 21 is switched on or accelerated in order to replenish the yarn supply. The third sensor S3 is a maximum sensor monitoring the maximum allowable size of the yarn supply and generating a signal to switch off or decelerate the drive of the winding element in case of presence of yarn Y in this region. The turns of the yarn Y wander in FIG. 10, e.g. with yarn separation, from left to right.

The three feeler arms F are pivotally supported on a common axis 18 and are biased towards a defined (lowered) home position by a spring assembly C. Each feeler arm has a feeler arm part 17 carrying a stop 19 for co-operation with the spring assembly C and an insertion socket 16. Into insertion socket 16, e.g. a leg 2', 3' of the feeler foot A is inserted. Moreover, detecting devices T are provided for each feeler arm F which, e.g. contactlessly and in an optoelectronic fashion, generate signals if the associated feeler arm F is in the home position or has been displaced therefrom. In the home position the resting surfaces B or surface P of each feeler foot A is spaced apart from the bottom of the depression 22. Said distance is set so that the yarn Y when passing below the feeler foot forcedly displaces the feeler foot upwardly from its home position. In the sensor arrangement according to FIG. 10 three sensors are combined with another within little mounting space. However, more than three sensors or even fewer could be provided. The feeler feet are of equal design (rational manufacturing); for the adaptation to the current mounting environment the leg 2', 3' which is not inserted into an insertion socket 16 is shortened to the necessary length.

Although particular preferred embodiments of the invention has been disclosed in detail for illustrative purposes, it will be recognized that variations or modifications of the disclosed apparatus, including the rearrangement of parts, lie within the scope of the present invention.

What is claimed is:

1. A yarn feeler for a yarn sensor in a yarn feeding device, the yarn feeler comprising a feeler foot defining an even resting surface which is brought into contact with a yarn, wherein the feeler foot is provided with an uninterrupted surface in the region of the resting surface such that the feeler foot is free of any contaminant collecting opening.

2. The yarn feeler of claim 1 wherein the resting surface includes a part which is located at a tip of the feeler foot which is substantially parallel to the moving direction of the yarn.

3. The yarn feeler of claim 1 wherein the feeler foot is either hollow or solid and is constructed of either metal or plastic, and the uninterrupted surface is integrally formed with the feeler foot.

4. The yarn feeler of claim 1 wherein the yarn feeler is defined by a pair of spaced-apart legs, each of the legs having first and second portions which are transverse with respect to one another, the first portions of the respective legs being disposed adjacent one another and defining a shank of the yarn feeler and the second portions of the respective legs defining the feeler foot, the second portions of the respective legs being either parallel to one another or converging relative to one another as same project away from the respective first portions.

5. The yarn feeler of claim 1 wherein the feeler foot is formed from a section of wire which defines a pair of legs between which a space is defined, and a hollow or solid insert is disposed within the space between the legs, the insert forming both the uninterrupted surface and the resting surface.

6. The yarn feeler of claim 1 wherein the feeler foot is formed from a section of wire which defines a pair of legs between which a space is defined, and a shoe-like cover is provided on the feeler foot which defines both the resting surface and the uninterrupted surface.

7. The yarn feeler of claim 1 wherein the feeler foot is defined by a pair of legs between which a space is defined, and a generally planar membrane-like element covers the space and defines the uninterrupted surface, the membrane being provided either on the legs or being inserted therebetween.

8. The yarn feeler of claim 1 further including a pair of spaced-apart legs which together define a shank of the yarn feeler, and a runner-like element defining both the resting surface and the uninterrupted surface is mounted to the shank and defines a free end of the yarn feeler.

9. The yarn feeler of claim 1 wherein the feeler foot is defined by a pair of spaced-apart legs between which a cavity is defined, and a filler material is disposed within the cavity to close off same.

10. The yarn feeler of claim 1 including a pair of spaced-apart legs which extend toward a storage drum of the yarn feeding device and together define a shank of the yarn feeler which is associated with a housing of the yarn sensor, the feeler foot being cantilevered from terminal ends of the respective legs and transversely oriented relative thereto.

11. A yarn feeler for a yarn sensor in a yarn feeding device, the yarn feeler having a feeler foot forming an even resting surface which is brought into contact with a yarn, wherein the feeler foot is provided with an uninterrupted surface in the region of the resting surface and a shank which is bent upwardly from a main plane of the resting surface, the uninterrupted surface extending from the resting surface into the shank.

12. A yarn feeler for a yarn sensor in a yarn feeding device having a storage drum on which yarn is stored in windings, said yarn feeler being formed from a wire material which is bent to define a pair of legs having adjacent leg portions which together define a feeler foot for engaging a yarn winding stored on the storage drum, said leg portions being spaced apart from one another such that a cavity is defined therebetween, said feeler foot including a continuous and uninterrupted surface which extends between said leg portions to close off said cavity and prevent the collection of contaminants therein.

13. The yarn feeler of claim 12 wherein said feeler foot includes a planar element mounted between the respective leg portions and extending transversely therebetween, said element defining said uninterrupted surface.

14. The yarn feeler of claim 13 wherein said element is mounted in flush relation with lower surfaces of the respective leg portions so as to function as a yarn engagement surface of said feeler foot.

15. The yarn feeler of claim 14 wherein said leg portions are first leg portions and said legs have second leg portions which define upward extensions of the respective first leg portions and are oriented transversely relative thereto, said second leg portions defining a shank of said yarn feeler and said element having an edge flange which is bent so as to extend a short distance upwardly between the respective second leg portions.

16. The yarn feeler of claim 13 wherein said element comprises a thin membrane-like element which is disposed a short distance upwardly from lower surfaces of the respective leg portions, said lower surfaces respectively defining yarn engagement surfaces.

17. The yarn feeler of claim 12 wherein said feeler foot includes a planar element mounted to respective lower surfaces of said leg portions and extending transversely therebetween, said planar element defining said uninterrupted surface thereon which also functions as a yarn engagement surface.

18. The yarn feeler of claim 17 wherein said leg portions are first leg portions and said legs have second leg portions which define upward extensions of the respective first leg portions and are oriented transversely relative thereto, said second leg portions defining a shank of said yarn feeler and said planar element having a peripheral edge flange which is bent upwardly so as to extend a short distance upwardly along said second leg portions.

19. The yarn feeler of claim 12 including a shoe-like cover which extends over said feeler foot, said cover defining thereon said uninterrupted surface which also functions as a yarn engagement surface.

20. The yarn feeler of claim 19 wherein said cover defines a hollow interior which contains a filler material.

21. The yarn feeler of claim 12 wherein said feeler foot includes an insert mounted between the respective leg portions and extending transversely therebetween, said insert defining thereon said uninterrupted surface which also functions as a yarn engagement surface, said insert having a thickness which is similar to the thickness of said leg portions and a peripheral edge portion having a contour which smoothly follows the contours of inner regions of the respective leg portions.

22. The yarn feeler of claim 12 wherein said leg portions are first leg portions and said legs have second leg portions which define upward extensions of the respective first leg portions and are oriented transversely relative thereto, said second leg portions defining a shank of said yarn feeler and extending generally downwardly from a housing of the yarn sensor and said first leg portions being cantilevered from respective lower ends of said second leg portions and joined to one another to define an outer free terminal end of said feeler foot, said feeler foot having a U-shape when viewed from above or below.

* * * * *